US010535951B2

(12) United States Patent
Listing et al.

(10) Patent No.: US 10,535,951 B2
(45) Date of Patent: Jan. 14, 2020

(54) PLUG CONNECTOR AND METHOD FOR PRODUCING A PLUG CONNECTION

(71) Applicant: TE Connectivity Germany GmbH, Bensheim (DE)

(72) Inventors: Martin Listing, Langen (DE); Walter Saenger, Fuerth/Odw. (DE); Wolfgang Balles, Mannheim (DE); Kai Kioschis, Moerlheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/945,180

(22) Filed: Apr. 4, 2018

(65) Prior Publication Data

US 2018/0287299 A1 Oct. 4, 2018

(30) Foreign Application Priority Data

Apr. 4, 2017 (DE) ..... 1 2017 003 296

(51) Int. Cl.

| | |
|---|---|
| ***H01R 13/62*** | (2006.01) |
| ***H01R 13/629*** | (2006.01) |
| ***H01R 13/52*** | (2006.01) |
| ***H01R 43/26*** | (2006.01) |
| *H01R 13/64* | (2006.01) |

(52) U.S. Cl.

CPC ... *H01R 13/62977* (2013.01); *H01R 13/5221* (2013.01); *H01R 13/62938* (2013.01); *H01R 43/26* (2013.01); *H01R 13/64* (2013.01)

(58) Field of Classification Search

CPC ..... H01R 13/62977; H01R 13/5221; H01R 13/62938; H01R 43/26

USPC ..... 439/157

See application file for complete search history.

(56) References Cited

U.S. PATENT DOCUMENTS 4,303,292 A * 12/1981 McNeel ..... H01R 13/629 439/152
4,487,467 A * 12/1984 Guerrero ..... H01R 13/629 439/285
5,061,197 A * 10/1991 Kuzuno ..... H01R 13/193 439/262

(Continued)

FOREIGN PATENT DOCUMENTS

DE 20 2005 017 188 U1 4/2006
DE 20 2009 015 913 U1 6/2011
FR 2871956 A1 12/2005

OTHER PUBLICATIONS

Abstract of DE 20 2005 017 188, dated Mar. 2, 2006, 1 page.
Abstract of FR2871956, dated Dec. 23, 2005, 2 pages.

*Primary Examiner* — Alexander Gilman
(74) *Attorney, Agent, or Firm* — Barley Snyder

(57) ABSTRACT

A plug connector comprises a first plug, a second plug, and a securing device configured to mechanically secure the first plug to the second plug. The second plug has a receptacle with a ramp surface and a locking surface. The securing device has a lever pivotably mounted on the first plug. The lever pivotably bears a connecting element which has a securing cam on a free end of the connecting element. The receptacle of the second plug receives the securing cam and the ramp surface of the receptacle cooperates with the free end of the connecting element to forcibly guide the securing cam behind the locking surface of the receptacle when the first plug and the second plug are plugged together.

24 Claims, 12 Drawing Sheets

(56) References Cited

U.S. PATENT DOCUMENTS

| | | | | |
|---|---|---|---|---|
| 5,873,745 | A * | 2/1999 | Duclos | H01R 13/62944 439/157 |
| 6,019,620 | A * | 2/2000 | Kodama | H01R 13/62966 439/157 |
| 6,210,184 | B1 * | 4/2001 | Kodama | H01R 13/621 439/157 |
| 6,739,888 | B2 * | 5/2004 | Kato | B60L 3/00 439/157 |
| 7,976,332 | B2 * | 7/2011 | Matsumura | H01R 13/629 439/374 |
| 9,153,908 | B2 * | 10/2015 | Shimizu | H01R 13/629 |
| 9,331,427 | B2 * | 5/2016 | Tedeschi | H01R 4/4836 |
| 9,496,643 | B2 * | 11/2016 | Kato | H01R 13/623 |
| 9,496,645 | B2 * | 11/2016 | Reed | H01R 13/6275 |
| 9,608,357 | B1 * | 3/2017 | Sundarakrishnamachari | H01R 13/4534 |
| 2004/0152355 | A1 * | 8/2004 | Rudy | H01R 4/4836 439/438 |
| 2012/0058656 | A1 * | 3/2012 | Littek | H01R 13/62922 439/157 |

* cited by examiner

PLUG CONNECTOR AND METHOD FOR PRODUCING A PLUG CONNECTION

CROSS-REFERENCE TO RELATED APPLICATION

This application claims the benefit of the filing date under 35 U.S.C. § 119(a)-(d) of German Patent Application No. 102017003296.3, filed on Apr. 4, 2017.

FIELD OF THE INVENTION

The present invention relates to a plug connector and, more particularly, to a plug connector having a first plug and a second plug matable with one another.

BACKGROUND

A plug connector including a first plug matable with a second plug to electrically connect elements of the first plug and second plug is generally known. A securing device of the plug connector mechanically secures the connection of the first plug and the second plug.

In some applications of plug connectors, in particular in electric vehicles, vibration can stress the connection of the first plug and the second plug. Because electric vehicles are powered by high-voltage current, a secure and enduring connection between the first plug and the second plug must be ensured. Moreover, basic manufacturing conditions require that parts which are to be joined particularly in the automotive industry are joined to each other reliably and as error-free as possible. Faulty connections within the context of manufacturing can lead to the failure of the vehicle and to dissatisfaction from the vehicle owner.

SUMMARY

A plug connector comprises a first plug, a second plug, and a securing device configured to mechanically secure the first plug to the second plug. The second plug has a receptacle with a ramp surface and a locking surface. The securing device has a lever pivotably mounted on the first plug. The lever pivotably bears a connecting element which has a securing cam on a free end of the connecting element. The receptacle of the second plug receives the securing cam and the ramp surface of the receptacle cooperates with the free end of the connecting element to forcibly guide the securing cam behind the locking surface of the receptacle when the first plug and the second plug are plugged together.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
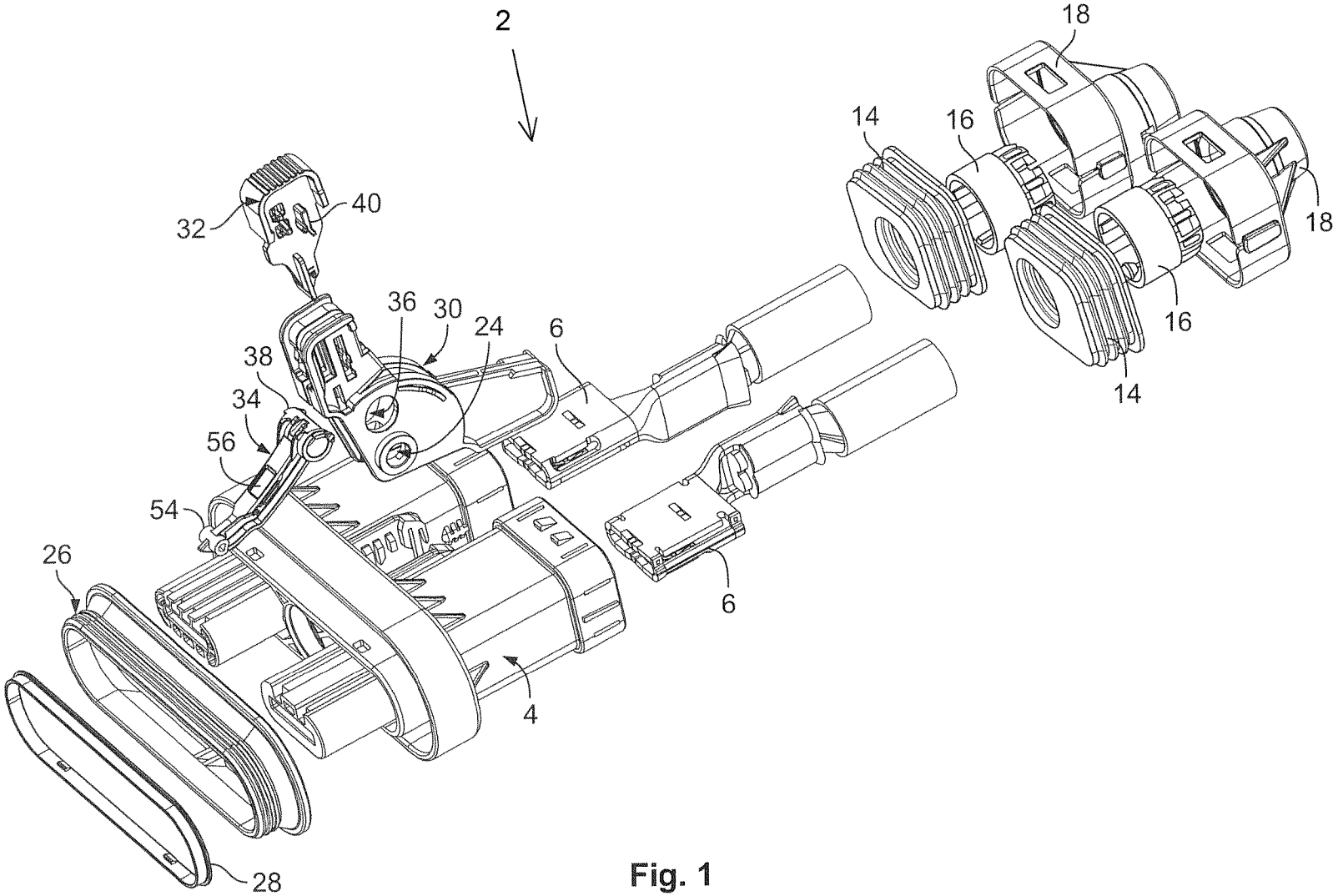
FIG. 1 is an exploded perspective view of a first plug of a plug connector.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A first plug 2 of a plug connector according to an embodiment is shown in FIG. 1. The first plug 2 has a plug housing 4 in which female plug contacts 6 are disposed. In an embodiment, the plug housing 4 is injection molded of a plastic material. An end of each of the female plug contacts 6 is connected to an electrical cable 8 by crimping. The first plug 2 also has a plurality of single-core seals 14 for sealing a feedthrough of each of the electrical cables 8 and a strain relief 16 for each electrical cable 8 which interacts with a conical receptacle of a cover cap 18. The strain relief 16 rests against a jacket of the cable 8 and holds the cable 8 in a strain-relieved manner inside the plug housing 4.

Figure 2:
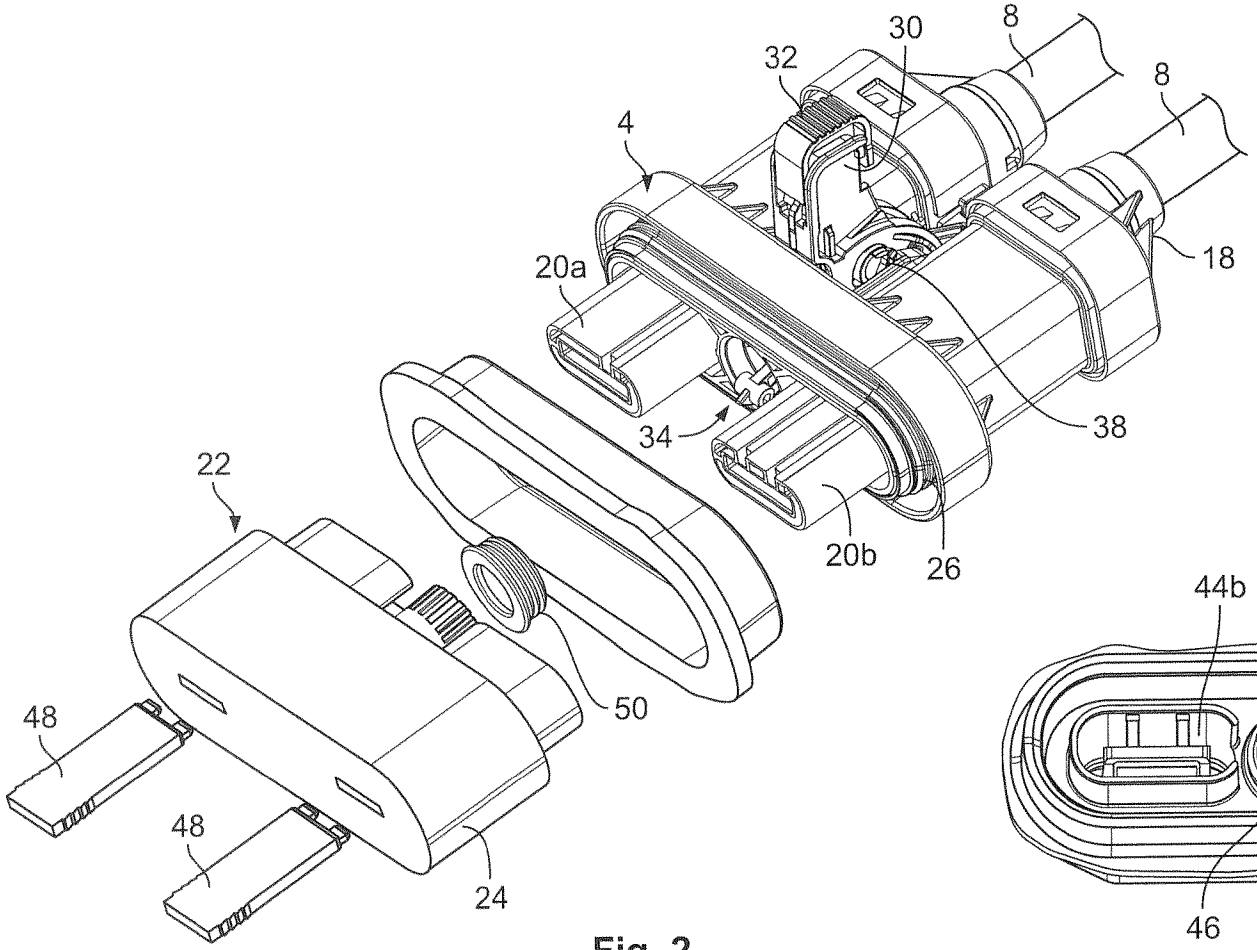
FIG. 2 is an exploded perspective view of a second plug of the plug connector with the first plug.
Figure 3:
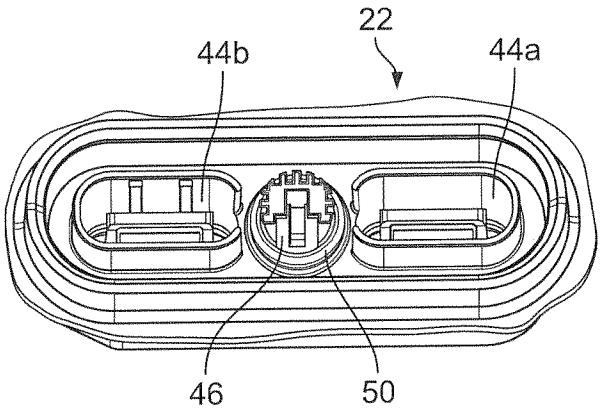
FIG. 3 is a perspective view of a front of the second plug.
Figure 4:
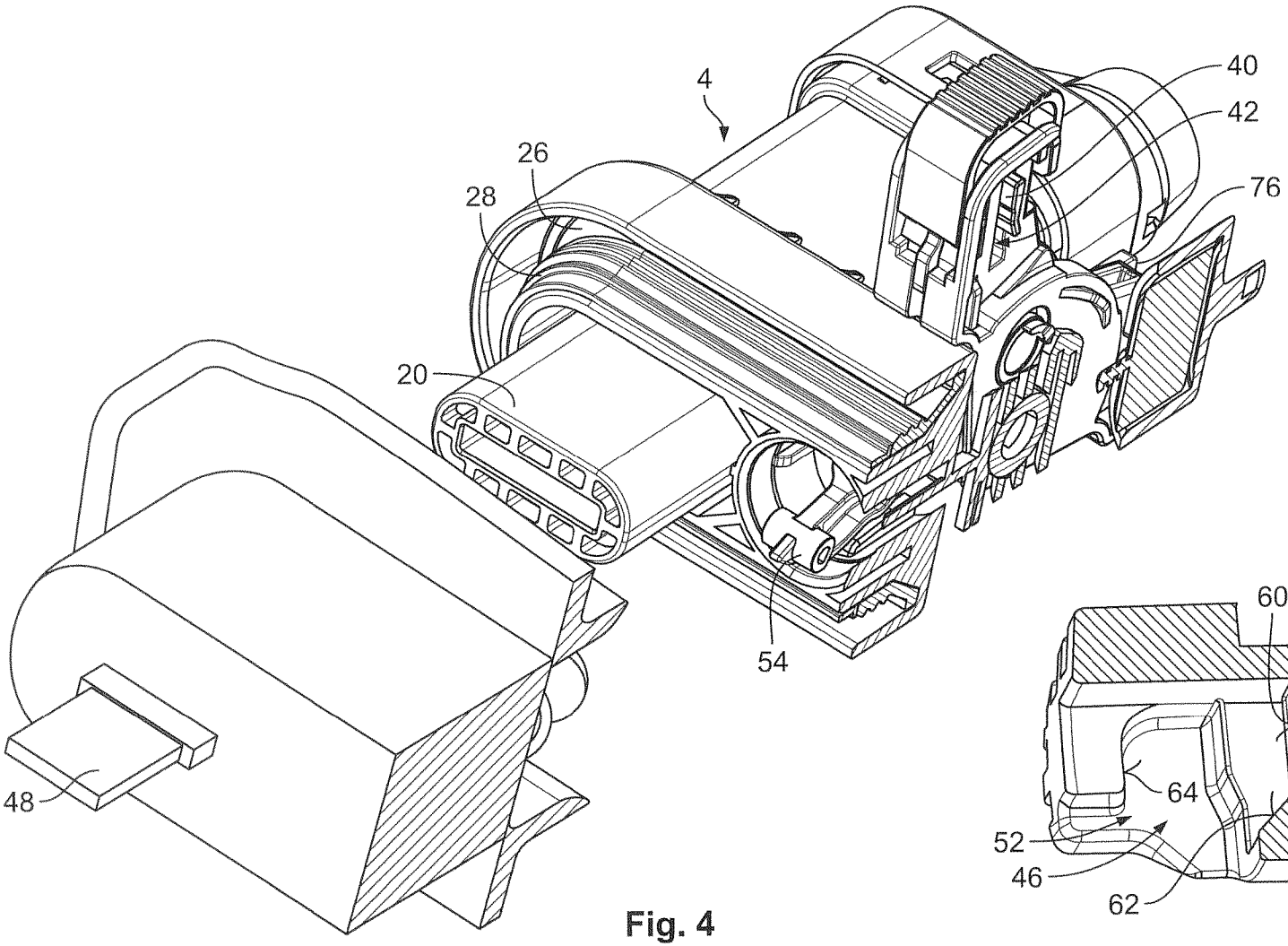
FIG. 4 is a sectional perspective view of the first plug and the second plug.

The plug housing 4, as shown in FIGS. 2-4, has connecting pieces 20*a*, 20*b* which lead to the female plug contacts 6. The connecting pieces 20*a*, 20*b* have different grooves on a surface of each of the connecting pieces 20*a*, 20*b* in order to enable the first plug 2 to be plugged into a second plug 22 only in a particular orientation as shown in FIGS. 2-4. A plug housing 24 of the second plug 2 has guide webs which engage in the grooves of the connecting pieces 20*a*, 20*b*, as shown in FIG. 3. The connecting pieces 20*a*, 20*b* project beyond a seal 26 which is received in a circumferential U-shaped groove of the plug housing 4 and secured via a seal holder 28 on the plug housing 4.

A lever 30 is pivotally mounted on the plug housing 2 as shown in FIGS. 1 and 2. The lever 30 has an essentially symmetrical structure about a central longitudinal axis and has a receiving space receiving a securing element 32 and an end of a connecting element 34.

The lever 30, as shown in FIG. 1, has an elongated hole 36 against which the connecting element 34 pivotally bears. The elongated hole 36 has a diameter which is greater than an outer diameter of a bearing pin 38 integrally formed on the connecting element 34 and disposed in the elongated hole 36. The connecting element 34 can therefore be moved relative to the lever 30 in a translating manner.

The lever 30, the securing element 32, and the connecting element 34 together form a securing device 30, 32, 34 securing the first plug 2 in a plugged-in state in the second plug 22.

The two halves of the lever 30 are forced apart in order to bring the end, on the mounting side, of the connecting element 34 between the two halves and into the receiving space, inserting the bearing pin 38 into the elongated hole 36.

The securing element 32 is guided between the two halves of the lever 30 in the same manner. The securing element 32 has latching webs 40 shown in FIG. 1 which project from its major side surfaces and which cooperate with latching grooves 42 which are formed on the halves of the lever 30 shown in FIG. 4. The interaction of the latching webs 40 and the latching grooves 42 permit a somewhat guided displacement movement of the securing element 32 relative to the lever 30 and secure, by a latching connection, a locking position in which the securing element 32 is fixed relative to the lever 30. The securing element 32 also fixes the two halves of the lever 30 against each other with the bearing pin 38 and latching webs 40.

The second plug 22, as shown in FIGS. 2 and 3, has connecting piece receptacles 44*a*, 44*b* which are adapted for receiving the connecting pieces 20*a*, 20*b*. A receptacle 46 is disposed between the connecting piece receptacles 44*a*, 44*b*. The connecting piece receptacles 44*a*, 44*b* and the receptacle 46 are formed through the plug housing 24 of the second plug 22. A plurality of male plug contacts 48 are disposed in the plug housing 24. The receptacle 46 projects beyond a front surface of the plug housing 24 and forms an insertion opening 52, shown in FIG. 5, upstream of a seal ring 50 disposed around the receptacle 46. The insertion opening 52 receives a securing cam 54 which is disposed on the free end of the connecting element 34. The securing cam 54 projects beyond an elongated connecting web 56 of the connecting element 34 as shown in FIG. 1.

Figure 5:
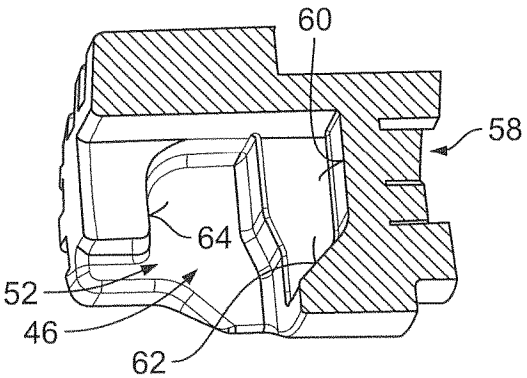
FIG. 5 is a detailed sectional view of a receptacle of the second plug.

As shown in FIG. 5, a receiving body 58 which forms the receptacle 46 receives the securing cam 54. The receiving body 58 is fixed on the plug housing 24; in an embodiment, the receiving body 58 is integrally formed on the plug housing 24 by injection molding. The receiving body 58 has different surfaces which cooperate with the free ends of the connecting element 34 and the securing cam 54 during the mating of the plugs 2, 22 as shown in FIG. 5. Opposite the insertion opening 52, the receiving body 58 has a stop surface 60 which connects to a ramp surface 62 formed in the joining direction opposite the insertion opening 52. The insertion opening 52 is delimited on the inside by a locking surface 64 which is formed opposite the stop surface 60. The locking surface 64 is outwardly offset with respect to the central longitudinal axis whereas the ramp surface 62 and the stop surface 60 intersect the central longitudinal axis. The receptacle 46 is slit along the central longitudinal axis, as shown in FIG. 3, and is thus adapted to receive the free end of the connecting web 56.

As shown in FIGS. 6A-6F, a spring 66 which is shaped integrally on the lever 30 projects beyond the mutually-opposing sides of the respective halves of the lever 30. The spring 66 abuts against the connecting element 34 under pretension. The bearing pin 38 is pressed against a lower region of the elongated hole 36 by this spring 66. A locking cam 68 projects beyond the bearing pin 38 axially on both sides, as shown in FIGS. 7A-7C, and cooperates with a mating surface 70 of the plug housing 4 to create a pivot lock 68, 70 in the initial position shown in FIGS. 6A and 7A. The locking cam 68 is held against the mating surface 70 by the force of the spring 66. As a result, a pivoting of the lever 30 is prevented and the spring 66 holds the lever 30 in the initial position shown in FIGS. 6A and 7A.

Figure 6A:
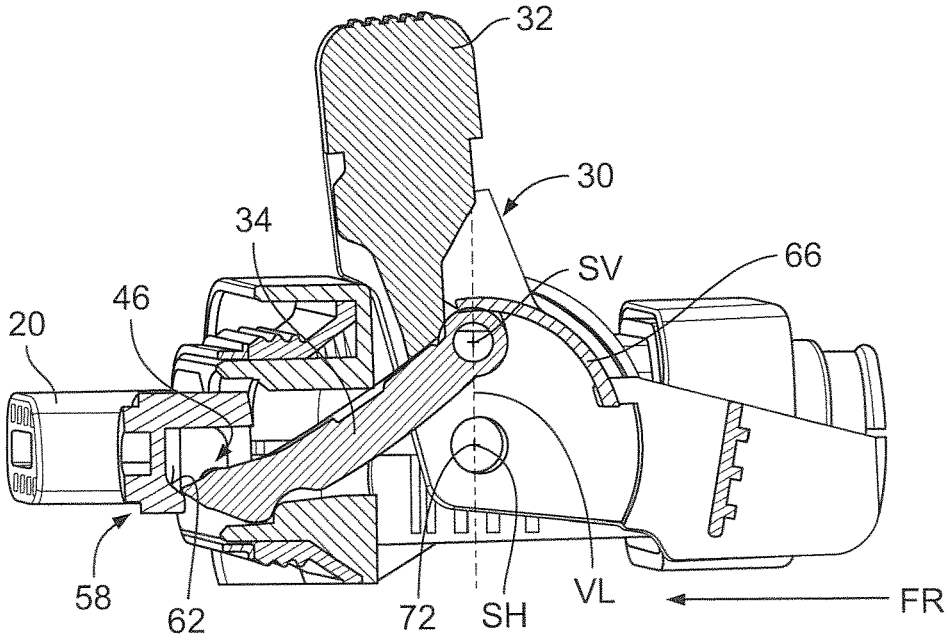
FIG. 6A is a sectional view of the first plug and the second plug in an initial position of joining the first plug and the second plug.
Figure 6B:
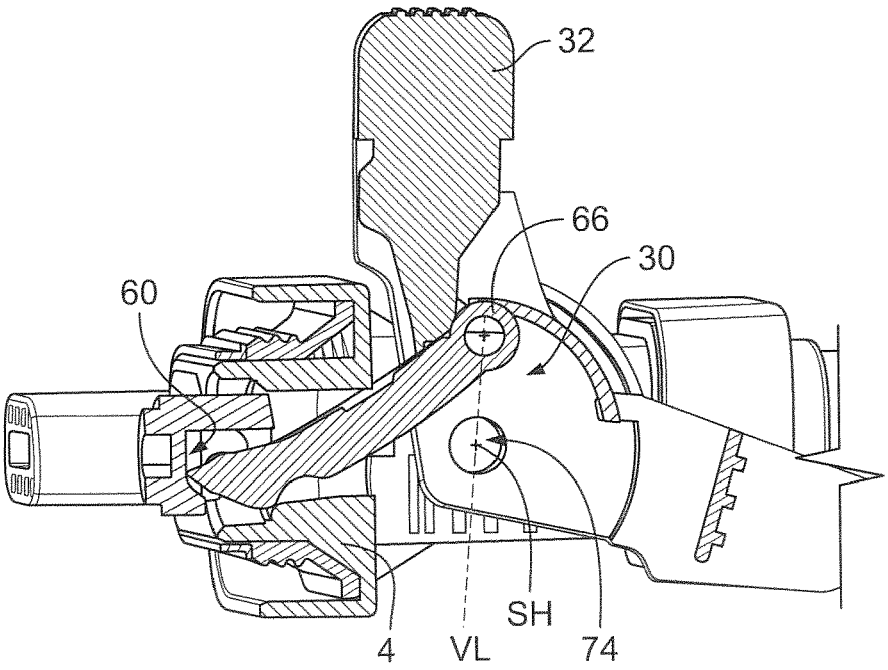
FIG. 6B is a sectional view of the first plug and the second plug in a second position of joining the first plug and the second plug.
Figure 6C:
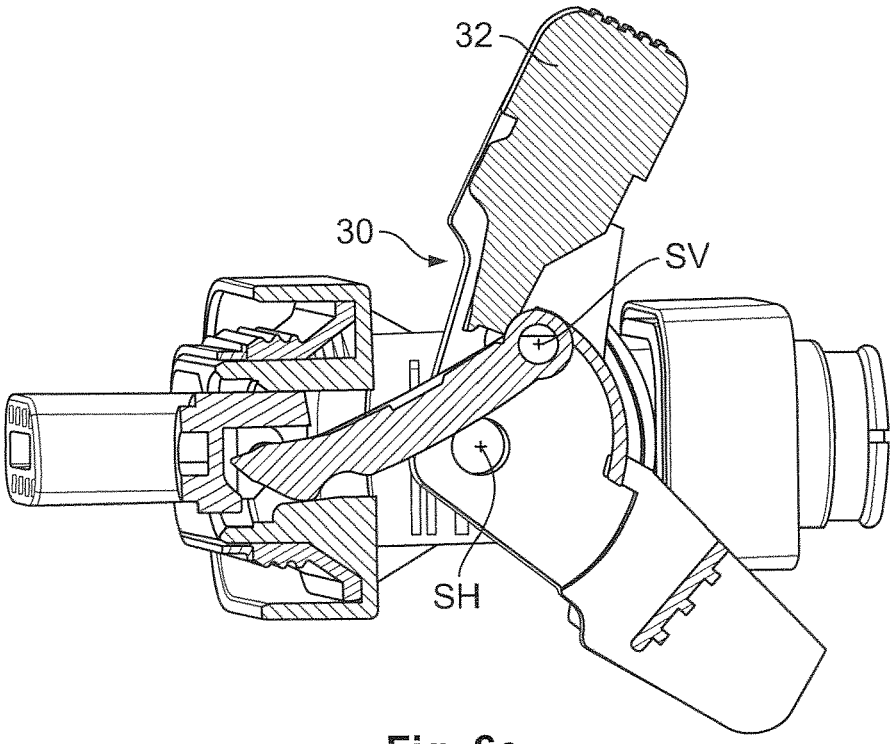
FIG. 6C is a sectional view of the first plug and the second plug in a third position of joining the first plug and the second plug.
Figure 6D:
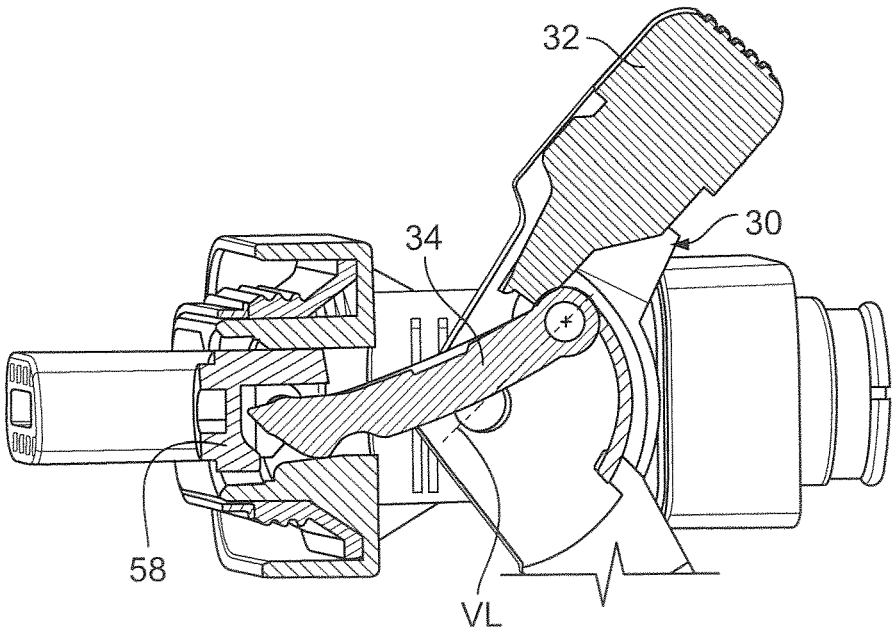
FIG. 6D is a sectional view of the first plug and the second plug in a fourth position of joining the first plug and the second plug.

A pivot axis SH of the lever 30, shown in FIGS. 6A and 6B, is formed by a housing pin 72 of the plug housing 4 which engages in a recess 74 of the lever 30. The plug housing 4 has two mutually-opposing housing pins 42 which are each engaged respectively in a recess 74 of the corresponding halves of the lever 30. To be assembled, these halves are elastically moved towards each other until the housing pins 72 latch into the recesses 74. The connecting element 34 has a pivot axis SV. The pivot axes SH and SV extend parallel to each other and substantially at right angles to the plane of FIGS. 6A-6F.

The pivot axes SH and SV are connected to each other by a virtual connecting line VL shown in FIGS. 6A and 6B. The connecting line VL extends in the initial position shown in FIG. 6A essentially at a right angle to a joining direction FR. The joining direction FR is the longitudinal extension of the connecting pieces 20*a*, 20*b*, along which the connecting pieces 20*a*, 20*b* are guided into the connecting piece receptacles 44*a*, 44*b* during the plugging-together of the two plugs 2, 22.

When the two plugs 2, 22 approach each other, the free end of the connecting element 34 is situated in a lowered position shown in FIG. 6A. The lowered position of the connecting element 34 is determined by an initial position of the lever 30, which is determined by a cooperation of the locking cam 68 with the mating surface 70 on both sides of the lever 30. Additionally, the connecting element 34 is pressed into the lowered position by housing surfaces of the plug housing 4, as indicated in FIG. 6A by the upper edge of a channel inside the plug housing 4.

A displacement movement of the lever 30 is shown in FIGS. 6A-6E and FIGS. 7A-7E. The securing element 32 is displaced in the direction of the receptacle 46, i.e. in the direction of the second plug housing 24. An orientation of the lever 30 with respect to the first plug 2 and the second plug 22 in each of FIGS. 6A-6E corresponds to the view shown in FIGS. 7A-7E; that is, FIGS. 6A and 7A show a same orientation, FIGS. 6B and 7B show a same orientation, etc. up to the end position shown in FIGS. 6E and 7E.

In the initial position shown in FIG. 6A, the securing cam 54 aligns with the insertion opening 52 in the joining direction FR. The securing cam 54 is thus firstly brought through the insertion opening 52 into the receptacle 46 during the plugging-together. The securing cam 54 passes the locking surface 64. With reference to the orientation shown in FIG. 5, the securing cam 54 is inserted into the receptacle 46 from left to right.

As shown in FIGS. 6B and 7B, the front free end of the connecting element 34 pushes against the ramp surface 62, as a result of which the connecting element 34 is raised in a forcibly guided manner. The securing cam 54 is thus guided in the joining direction FR behind the locking surface 64. By a slide guide created by the shape of the receptacle 46, the securing cam 54 is introduced into the receptacle 46 and subsequently is brought behind the locking surface 64. The pivoting movement through guidance along the ramp surface 62 comes to an end at the transition of the ramp surface 62 into the stop surface 60 shown in FIG. 5, the position of the lever 30 shown in FIGS. 6B and 7B.

A further joining movement leads to a counter-reaction of the connecting element 34. The connecting element 34 abuts against the stop surface 60 such that the bearing pin 38 is displaced inside the elongated hole 36 against the force of the spring 66. As a result, the locking cams 68 disengage with the mating surface 70 and is removed from the initial position against a force of the spring 66, permitting pivoting of the lever 30 only when the securing cam 54 is positioned behind the locking surface 64. This relative movement of the locking cam 68 is shown in FIGS. 7A and 7B. In FIG. 7B, the lever 30 has been pivoted in a clockwise direction with respect to FIG. 7A.

By pivoting the lever 30 as shown in FIGS. 6C and 6D and FIGS. 7C and 7D, the two housings 4, 24 are drawn towards each other. Because the connecting line VL in the initial position shown in FIGS. 6A and 7A extends essentially at a right angle to the joining direction FR, a toggle lever mechanism arises due to the pivoting movement of the lever 30; when the two plug housings 4, 24 come increasingly close together, leverage ratios are obtained which lead to low frictional forces and a progressively decreases movement of the housings 4, 24 toward each other shortly before reaching the end position shown in FIGS. 6E and 7E.

Figure 6E:
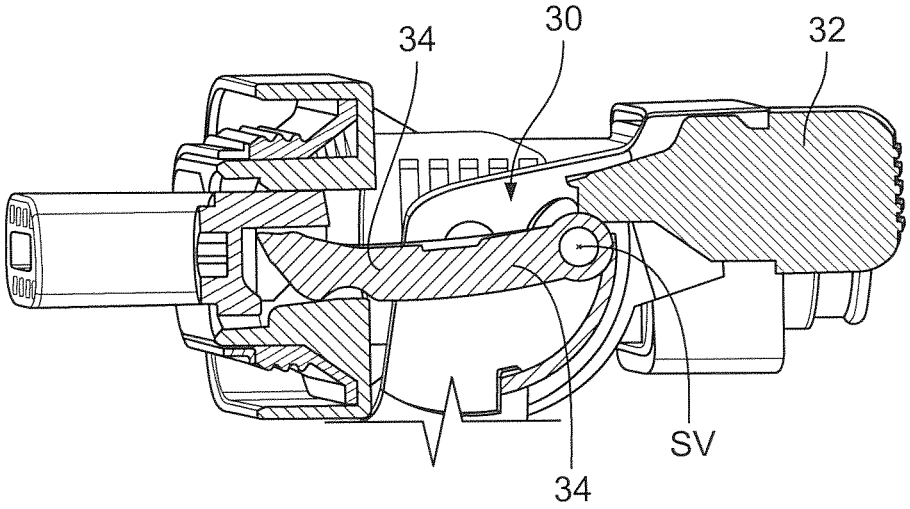
FIG. 6E is a sectional view of the first plug and the second plug in an end position of joining the first plug and the second plug.
Figure 7A:
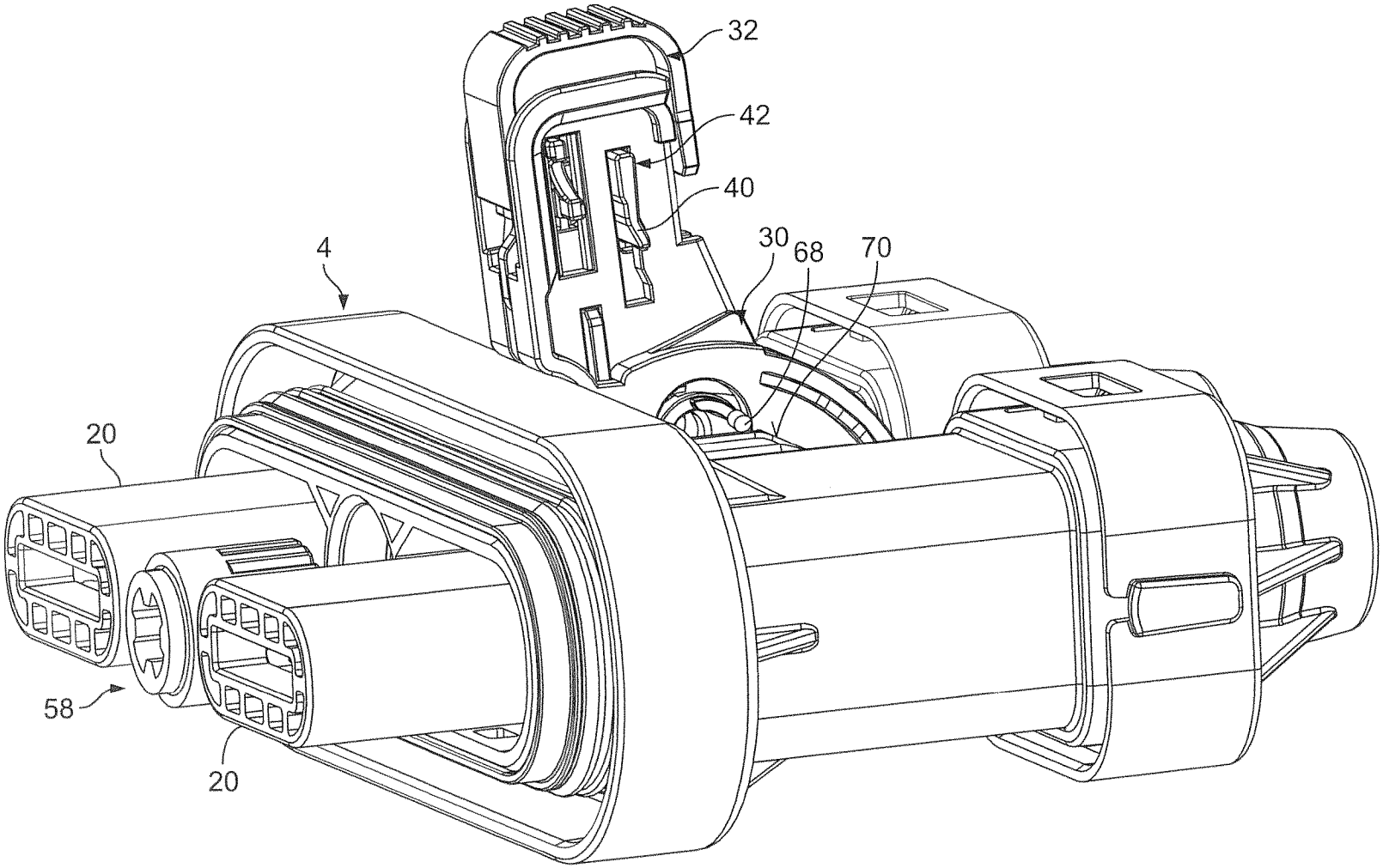
FIG. 7A is a perspective view of the first plug and the second plug in an initial position of joining the first plug and the second plug.
Figure 7B:
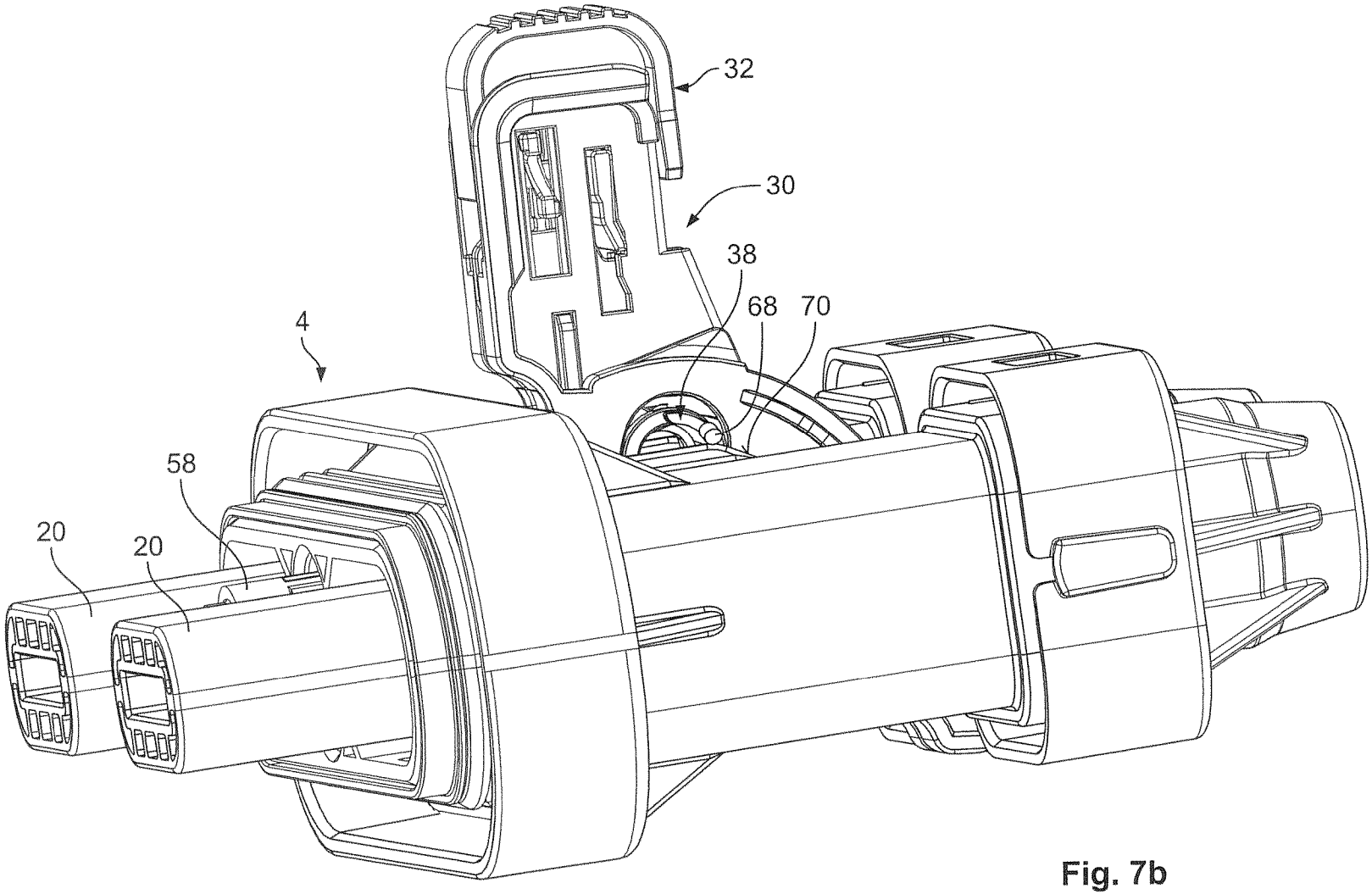
FIG. 7B is a perspective view of the first plug and the second plug in a second position of joining the first plug and the second plug.
Figure 7C:
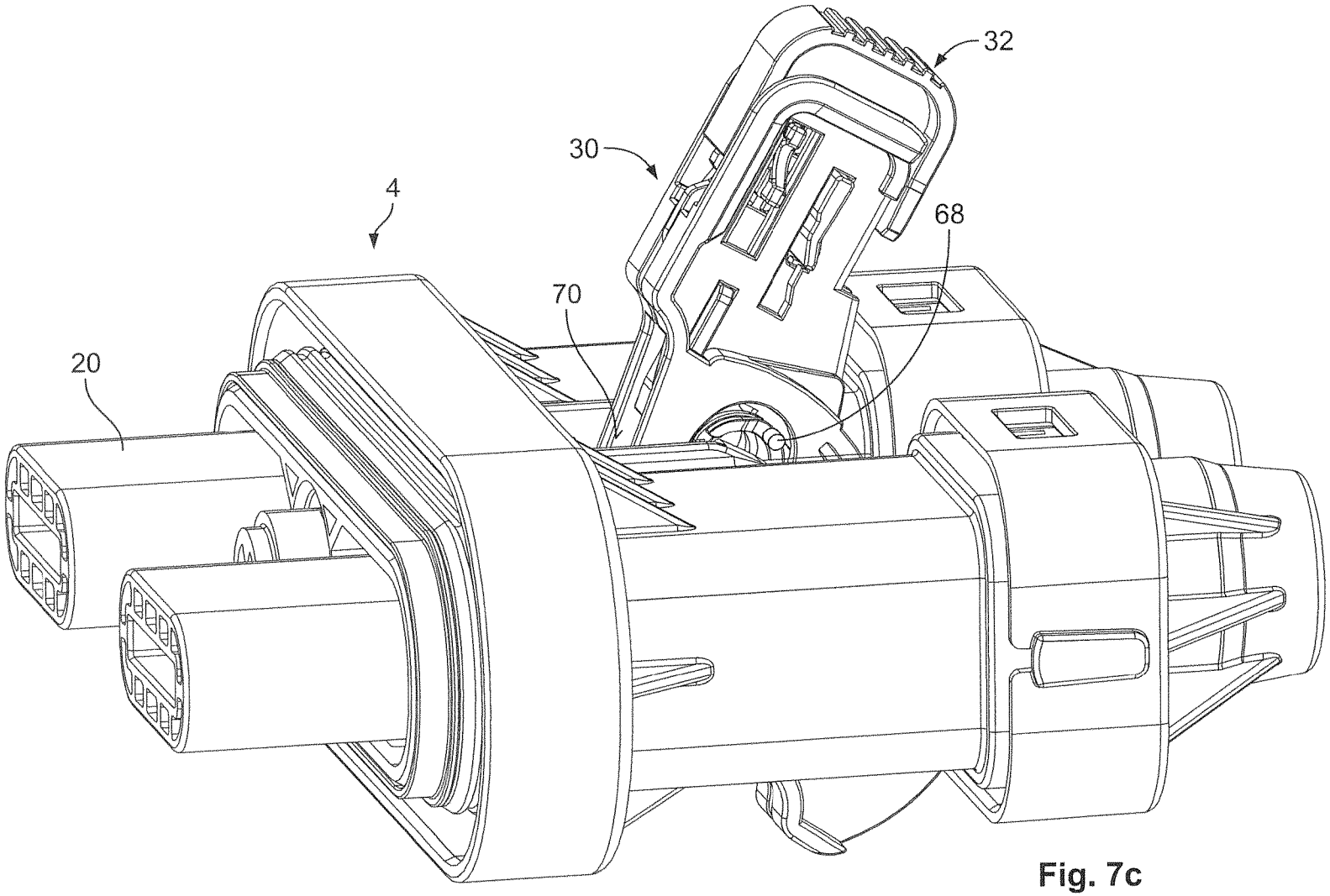
FIG. 7C is a perspective view of the first plug and the second plug in a third position of joining the first plug and the second plug.
Figure 7D:
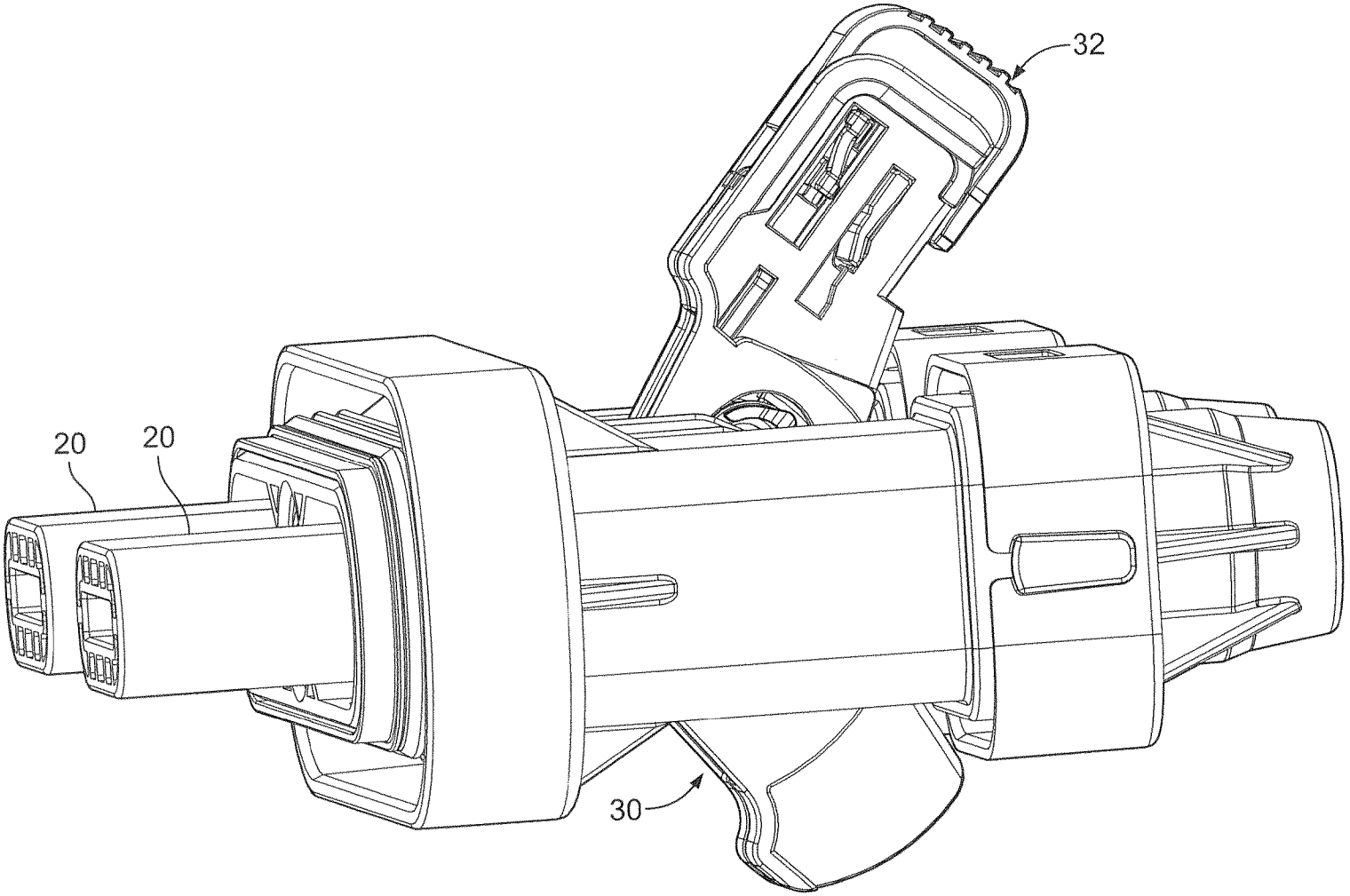
FIG. 7D is a perspective view of the first plug and the second plug in a fourth position of joining the first plug and the second plug.
Figure 7E:
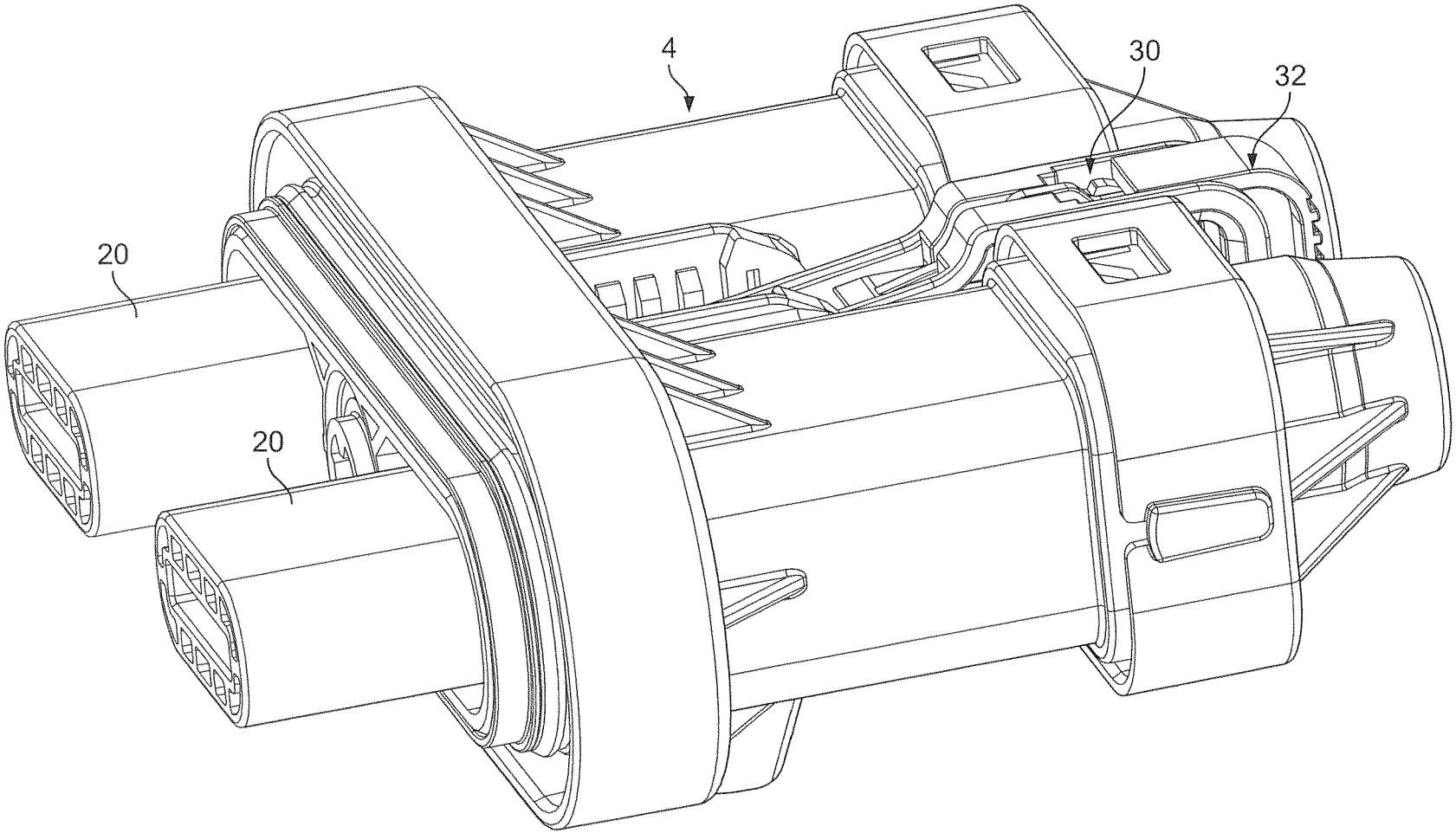
FIG. 7E is a perspective view of the first plug and the second plug in an end position of joining the first plug and the second plug.

In the end position shown in FIGS. 6E and 7E, the connecting line VL is located substantially parallel to the joining direction FR, the pivot axis SH of the lever 30 being located between the pivot axis SV of the connecting element 34 and the receptacle 46. The lever 30 is locked by virtue of the leverage ratios. The end position can be predetermined by the lever 30 stopping against the plug housing 4. This allows, for example, the second end of the lever 30 which is opposite the securing element 32 to stop against a mating surface of the plug housing 4, as shown in FIG. 6E.

Figure 6F:
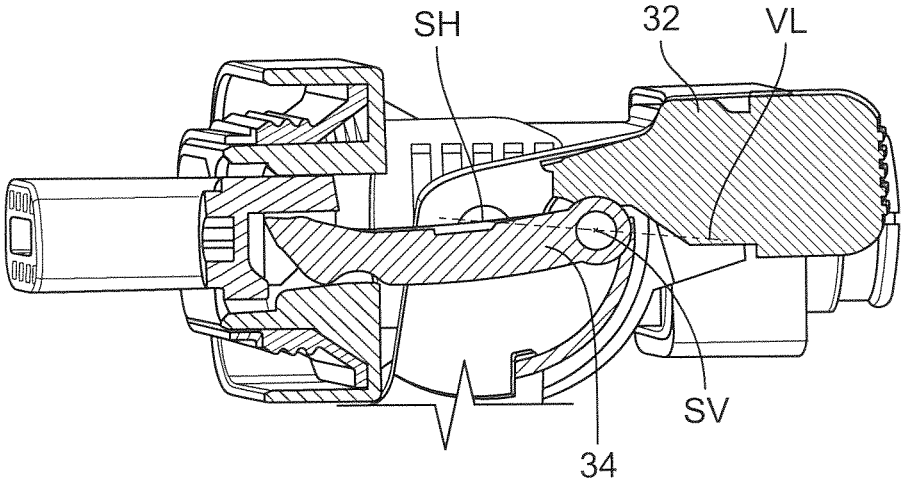
FIG. 6F is a sectional view of the first plug and the second plug in a locking position of joining the first plug and the second plug.
Figure 8:
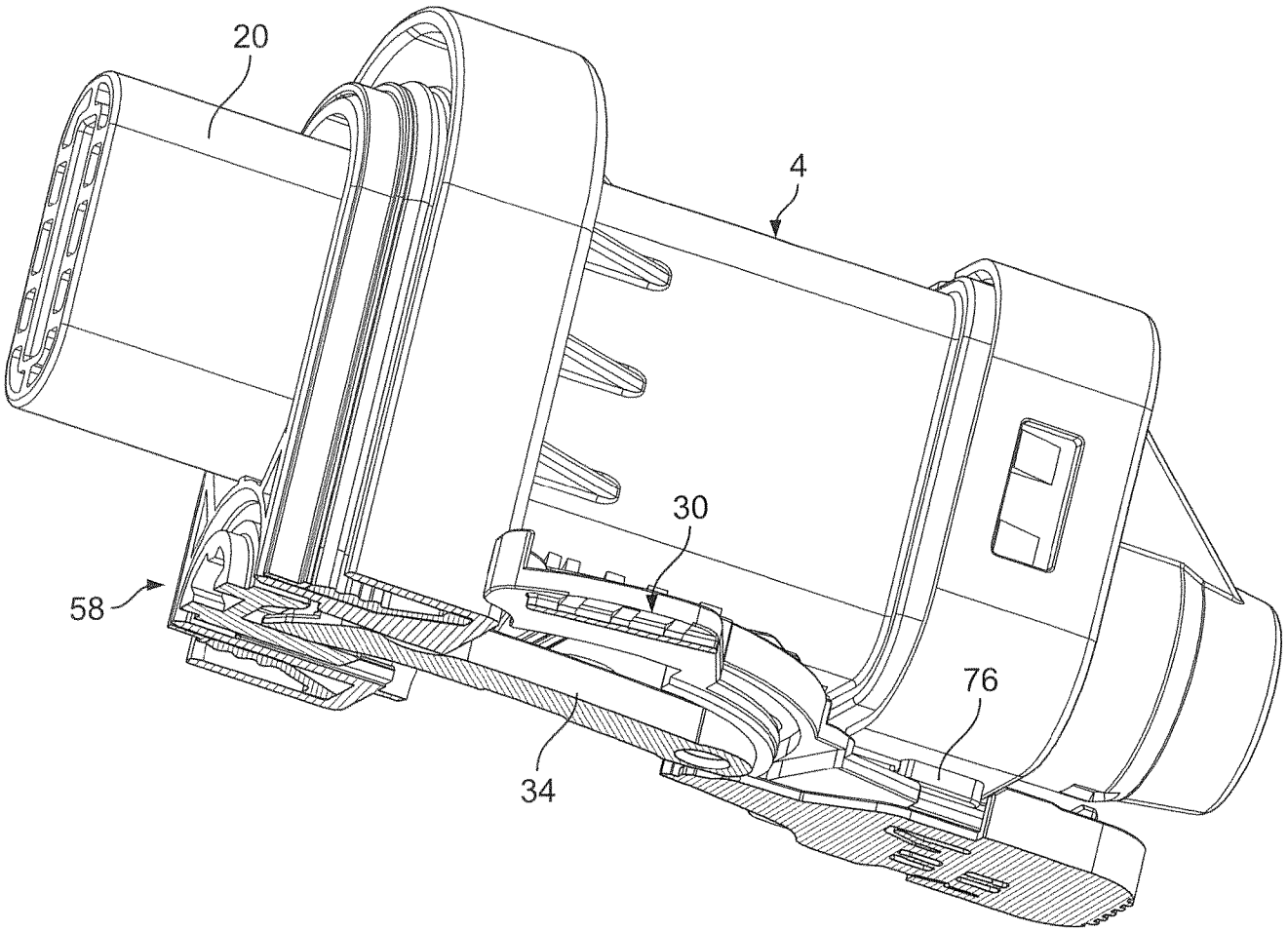
FIG. 8 is a sectional perspective view of the first plug and the second plug in the locking position.

In the end position shown in FIGS. 6E and 7E, the two plug housings 4, 24 abut against each other in a sealed manner in the region of the receiving body 58 below the intermediate layer of the seal 50. The securing element 32 is displaced, as shown in FIG. 6F, in the direction of the receptacle 46, in the direction of the second plug housing 24 into a locking position. No dirt or moisture can reach the plugged-together contacts 6, 48. A plurality of U-shaped outer receptacles of the securing element 32 are respectively displaced via securing protrusions 76 on a side of the plug housing 4 as shown in FIGS. 6F and 8. The end position is additionally secured by this form-fitting connection between the securing protrusions 76 and the securing element 32.

What is claimed is:

1. A plug connector, comprising:

a first plug having a first plug contact;

a second plug having a second plug contact connectable with the first plug contact by plugging together the first plug and the second plug and a receptacle with a ramp surface and a locking surface; and a securing device configured to mechanically secure the first plug to the second plug and having a lever pivotably mounted on the first plug, the lever pivotably bearing a connecting element which pivots relative to the lever, and further having a securing cam on a free end of the connecting element, the receptacle of the second plug receiving the securing cam and the ramp surface of the receptacle cooperating with the free end of the connecting element to forcibly guide the securing cam behind the locking surface of the receptacle when the first plug and the second plug are plugged together.

2. The plug connector of claim 1, wherein the lever pivotably mounted on the first plug has a first pivot axis and the connecting element pivotably connected to the lever has a second pivot axis different than the first pivot axis.

3. The plug connector of claim 1, wherein the connecting element is held in an initial position under pretension of a spring.

4. The plug connector of claim 3, wherein, in the initial position, the securing cam is aligned with an insertion opening of the receptacle in a joining direction in which the first plug and the second plug are plugged together.

5. The plug connector of claim 1, wherein the receptacle has a stop surface against which the connecting element abuts after the securing cam is guided behind the locking surface.

6. The plug connector of claim 3, wherein the connecting element has a locking cam.

7. The plug connector of claim 6, wherein, in the initial position, the locking cam cooperates with a mating surface of a plug housing of the first plug and prevents a pivoting movement of the lever.

8. The plug connector of claim 7, wherein the lever has an elongated hole which pivotably bears the connecting element.

9. The plug connector of claim 7, wherein the receptacle has a stop surface against which the connecting element abuts after the securing cam is guided behind the locking surface.

10. The plug connector of claim 9, wherein, when the connecting element abuts against the stop surface, the locking cam is removed from the mating surface of the plug housing against the force of the spring and the pivoting movement of the lever is permitted.

11. The plug connector of claim 1, wherein the lever is rotatable between an initial position and an end position after plugging the first plug into the second plug.

12. The plug connector of claim 11, wherein a securing element is pivotably mounted on the lever.

13. The plug connector of claim 12, wherein, with the lever in the end position, the securing element is movable into a locking position in which the lever is fixed by the securing element relative to a plug housing of the first plug.

14. The plug connector of claim 13, wherein, in the end position, a first pivot axis of the lever is disposed between the receptacle and a second pivot axis of the connecting element.

15. The plug connector of claim 14, wherein, in the initial position, a connecting line connecting the first pivot axis and the second pivot axis is perpendicular to a joining direction in which the first plug and the second plug are plugged together.

16. The plug connector of claim 15, wherein, in the end position, the connecting line is parallel to the joining direction.

17. A method of forming a plug connection between a first plug and a second plug, comprising:

providing a lever pivotably mounted on the first plug and pivotably bearing a connecting element which pivots relative to the lever, and further having a securing cam on a free end of the connecting element;

plugging the first plug into the second plug such that the securing cam is forcibly guided behind a locking surface formed on the second plug; and pivoting the lever to draw the first plug and the second plug toward each other.

18. The method of claim 17, wherein, after the securing cam is engaged behind the locking surface in a receptacle of the second plug, a pivot lock of the lever is removed such that the lever can be pivoted into an end position.

19. The method of claim 18, wherein, in the end position, a first pivot axis of the lever is disposed between the receptacle and a second pivot axis of the connecting element.

20. The method of claim 19, further comprising securing the end position using a securing element to couple the lever to a plug housing of the first plug.

21. A plug connector, comprising:

a first plug having a first plug contact;

a second plug having a second plug contact connectable with the first plug contact by plugging together the first plug and the second plug and a receptacle with a ramp surface and a locking surface; and a securing device configured to mechanically secure the first plug to the second plug and having a lever pivotably mounted on the first plug having a first pivot axis, the lever pivotably bearing a connecting element pivotably connected to the lever having a second pivot axis different than the first pivot axis and a securing cam on a free end of the connecting element, the receptacle of the second plug receiving the securing cam and the ramp surface of the receptacle cooperating with the free end of the connecting element to forcibly guide the securing cam behind the locking surface of the receptacle when the first plug and the second plug are plugged together.

22. A plug connector, comprising:

a first plug having a first plug contact;

a second plug having a second plug contact connectable with the first plug contact by plugging together the first plug and the second plug and a receptacle with a ramp surface and a locking surface; and a securing device configured to mechanically secure the first plug to the second plug and having a lever pivotably mounted on the first plug, the lever pivotably bearing a connecting element held in an initial position under pretension of a spring having a securing cam on a free end of the connecting element, the receptacle of the second plug receiving the securing cam and the ramp surface of the receptacle cooperating with the free end of the connecting element to forcibly guide the securing cam behind the locking surface of the receptacle when the first plug and the second plug are plugged together.

23. A plug connector, comprising:

a first plug having a first plug contact;

a second plug having a second plug contact connectable with the first plug contact by plugging together the first plug and the second plug and a receptacle with a ramp surface and a locking surface and a stop surface; and a securing device configured to mechanically secure the first plug to the second plug and having a lever pivotably mounted on the first plug, the lever pivotably bearing a connecting element which has a securing cam on a free end of the connecting element, the receptacle of the second plug receiving the securing cam and the ramp surface of the receptacle cooperating with the free end of the connecting element to forcibly guide the securing cam behind the locking surface of the receptacle when the first plug and the second plug are plugged together and the connecting element abutting the stop surface after the securing cam is guided behind the locking surface.

24. A method of forming a plug connection between a first plug and a second plug, comprising:

providing a lever pivotably mounted on the first plug and pivotably bearing a connecting element having a securing cam on a free end of the connecting element;

plugging the first plug into the second plug such that the securing cam is forcibly guided behind a locking surface formed on the second plug;

pivoting the lever to draw the first plug and the second plug toward each other; and after the securing cam is engaged behind the locking surface in a receptacle of the second plug, a pivot lock of the lever is removed such that the lever can be pivoted into an end position wherein, in the end position, a first pivot axis of the lever is disposed between the receptacle and a second pivot axis of the connecting element.

* * * * *